United States Patent [19]

Fontlladosa

[11] 4,310,095

[45] Jan. 12, 1982

[54] DISPLAY UNIT FOR DISPLAYING CONFECTIONARY ITEMS HAVING STICKS

[76] Inventor: Enrique B. Fontlladosa, Paris St. 184, Barcelona, Spain

[21] Appl. No.: 136,457

[22] Filed: Mar. 31, 1980

[30] Foreign Application Priority Data

Mar. 30, 1979 [ES] Spain ..... 242.396

[51] Int. Cl.[3] ..... A47B 97/08

[52] U.S. Cl. ..... 211/60 A; 248/450; 248/460

[58] Field of Search ..... 248/450, 459, 460, 174; 211/13, 60 A

[56] References Cited

U.S. PATENT DOCUMENTS

| | | | |
|---|---|---|---|
| 1,182,936 | 5/1916 | Shearer | 248/450 |
| 1,463,585 | 7/1923 | Kellogg | 248/174 X |
| 1,655,539 | 1/1928 | Freedman | 248/459 |
| 1,742,854 | 1/1930 | Ferguson | 248/450 |
| 1,989,540 | 1/1935 | Berkowitz | 248/459 X |
| 2,181,390 | 11/1939 | Barrett | 248/459 |
| 2,630,641 | 3/1953 | Hessdoerfer | 248/459 X |
| 4,216,936 | 8/1980 | De Selms | 248/460 |

*Primary Examiner*—William H. Schultz

*Attorney, Agent, or Firm*—Wenderoth, Lind & Ponack

[57] ABSTRACT

A display unit for displaying confectionary items having sticks includes a planar display member formed of a rigid material and having front and rear sides, a support member formed by a planar element folded along a pair of parallel fold lines to form a pair of parallel support legs extending transverse to the plane of the element. The element has formed therein, adjacent each fold line, cuts forming tabs such that when the legs are folded along the fold lines, the tabs extend outwardly from the element. An attachment and reinforcing member has a front side attached to the rear side of the display member and a rear side having formed therein slots positioned to receive the tabs of the support member. The support member thus supports the attachment and reinforcing member and the display member in an upright position. The display member has extending therethrough a plurality of orifices arranged in columns, each orifice being sized to receive a stick of a confectionary item. The front side of the attachment and reinforcing member has a plurality of elongated channels, each channel being positioned to confront a respective column of orifices.

8 Claims, 6 Drawing Figures

DISPLAY UNIT FOR DISPLAYING CONFECTIONARY ITEMS HAVING STICKS

BACKGROUND AND SUMMARY OF THE INVENTION

The present invention is directed to a display apparatus or unit for displaying confectionary items having sticks, such as lollipops.

The display unit of the present invention includes a planar display member formed of a rigid material and having front and rear sides. The front side may have thereon a printed decoration or indicia. The display member may be formed of a laminated material, such as cardboard or paperboard. The display member is resistant to easy bending.

The display unit further includes a support member formed by a planar element folded along a pair of parallel fold lines to form a pair of parallel support legs extending substantially transverse to the plane of the element. The element has formed therein, adjacent each fold line, cuts which form tabs such that, when the legs are folded along the fold lines, the tabs extend outwardly from the element in directions opposite to the directions of the legs. The element, when planar, may be trapezoidal-shaped, such that when the legs are folded along the fold lines, the legs themselves are trapezoidal-shaped. The element may include two pairs of longitudinally-spaced tabs. The tabs may be hook-shaped and have upper recesses.

The display unit further includes an attachment and reinforcing member having a front side attached to the rear side of the display member, thereby forming a laminar unit with the display member, and a rear side having formed therein slots positioned to receive the tabs of the support member. Thus, when the tabs of the support member are inserted into the slots of the attachment and reinforcing member, the support member supports the attachment and reinforcing member and the display member in an upright position.

The display member has extending therethrough a plurality of orifices arranged in columns, preferably substantially vertically aligned columns. Each orifice is of a size to receive therethrough a stick of a confectionary item to be displayed. The front side of the attachment and reinforcing member, i.e., the side attached to the display member, has provided therein a plurality of elongated channels. Each such channel is positioned to confront a respective column of orifices. Thus, when the sticks of the confectionary items are extended through the orifices, the free ends of the sticks will abut against and be retained in position by walls of the respective channels. Specifically, the sticks will be retained in the channels in a generally inclined manner. Preferably, the attachment and reinforcing member comprises a single member folded to form the front and back sides and the channels. The attachment and reinforcing member is formed of a material which is capable of being bent but at the same time, has sufficient rigidity to provide a reinforcing function for the display member. Such material may be a paperboard or cardboard material.

BRIEF DESCRIPTION OF THE DRAWINGS

Other objects, features and advantages of the present invention will be apparent from the following detailed description of one embodiment, with reference to the accompanying drawings, wherein.

DETAILED DESCRIPTION OF THE INVENTION

Figure 1:
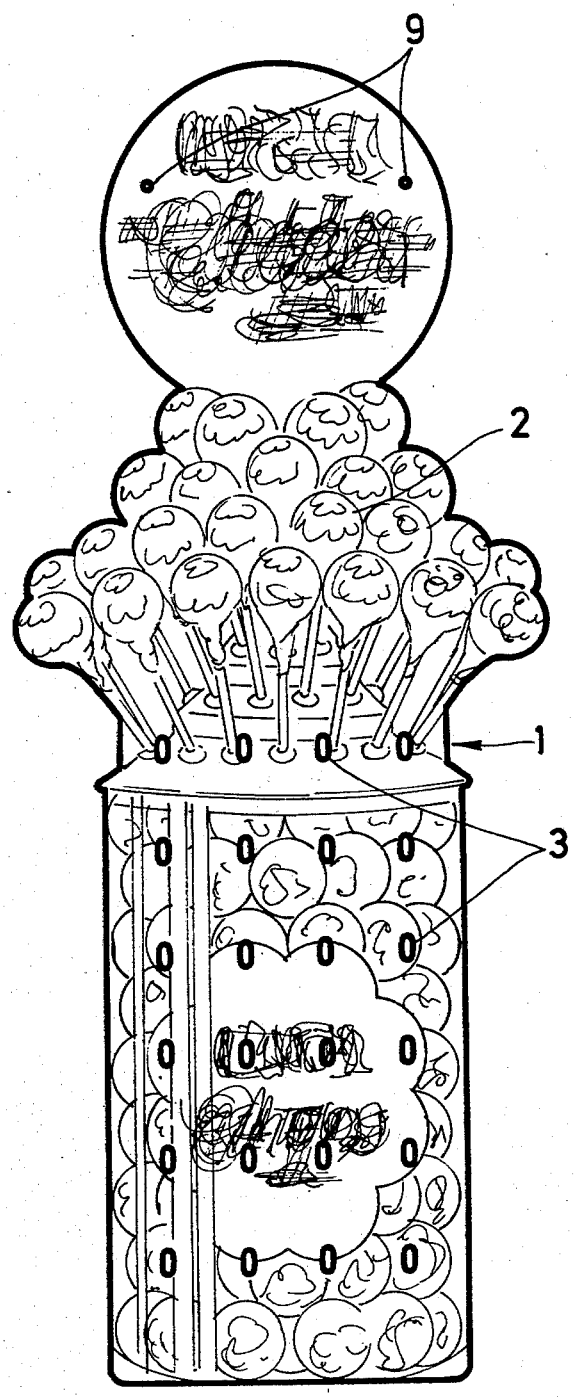
FIG. 1 is a front view of one embodiment of a display unit according to the present invention.

As shown in the drawings, the display unit 1 of the present invention generally includes three elements i.e., a planar display member 2, a support member 7 and an attachment and reinforcing member 4.

The display member 2 is formed of a rigid material which is resistant to easy bending, for example, paperboard or cardboard. The display member includes a front side and a rear side. The front side is shown in FIG. 1 and may have thereon, for example, by printing, suitable and desirable decoration and/or indicia. In the embodiment illustrated in FIG. 1, the front side of the display member is printed with decoration to resemble a candy jar filled with candy and having a top having lollipops extending thereinto.

Figure 2:
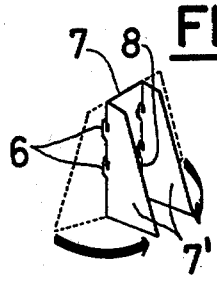
FIGS. 2, 3, 4 and 5 are partial perspective views illustrating the sequence of and manner of assembly of the various members of the display unit of the present invention; and, FIG. 6 is a schematic and generally horizontal cross-sectional view illustrating one embodiment of the formation and construction of the attachment and reinforcing member shown in FIGS. 3–5.

The support member 7, as shown in FIG. 2 by the dashed lines, is a generally planar, trapezoidal-shaped element folded along a pair of fold or score lines 8 to form a pair of parallel support legs 7' extending substantially transverse to the plane of the element. The element has formed therein, adjacent each fold line 8, cuts which form tabs 6, such that when the legs 7' are folded along the fold lines 8, the tabs 6 extend outwardly from the element in directions opposite to the directions of legs 7'. Preferably, the tabs 6 are hook-shaped and have upper recesses.

Figure 3:
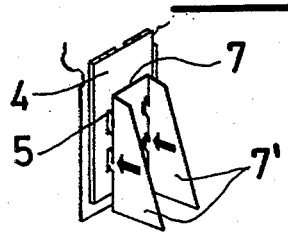
Figure 4:
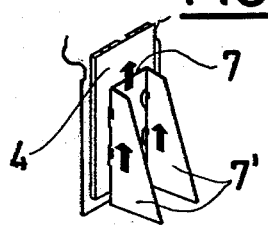
Figure 5:
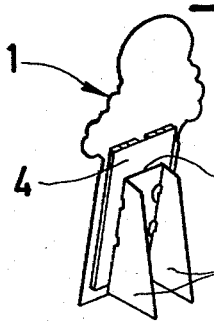

The attachment and reinforcing member 4, as shown in FIG. 3, has a front side attached to the rear side of the display member 2 and a rear side having formed therein slots 5 positioned to receive the tabs 6 of the support member 7. Thus, with sequential reference to FIGS. 2–5, the support member 7 is first folded along fold lines 8 to provide support legs 7'. The tabs 6 are then inserted into the slots 5 in the rear side of the attachment and reinforcing member 4 which is attached to the display member 2, as shown by the arrows in FIG. 3. The support member 7 is then moved upwardly with respect to the attachment and reinforcing member and the display member, as shown by the arrows in FIG. 4. This movement causes the upper recesses in tabs 6 to receive the attachment and reinforcing member. The assembled display unit is thus formed, as shown in FIG. 5.

As shown in FIG. 1, the display member 2 has formed therethrough a plurality of orifices 3 arranged in a plurality of columns, preferably vertically extending columns as shown in FIG. 1. Each orifice 3 is of a size to receive therein a stick of a confectionary item such as a lollipop.

Figure 6:
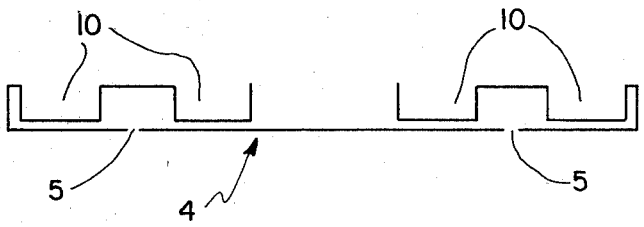

The front side of the attachment and reinforcing member 4 has provided therein a plurality of elongated channels 10, as shown in FIG. 6. Each channel is positioned to confront a respective column of orifices 3. Thus, when sticks of lollipops are extended through the orifices 3 and aligned in a generally inclined manner, the free ends of the sticks will abut against the walls of the respective channels 10 and be retained therein.

Preferably, the attachment and reinforcing member 4 is formed of a single member folded to form the front and back sides and the channels 10. The material of the member 4 may be a material, for example, paperboard or cardboard, which may be bent but which also has sufficient rigidity to provide a reinforcing function for display member 2. FIG. 6 is a schematic view, generally in horizontal cross-section, showing one manner in which a single member may be folded to form the attachment and reinforcing member 4 to have front and back sides and channels 10. It will be understood, however, that other folding arrangements may be provided to achieve similar results. In this regard, attention is directed to the fact that FIGS. 3–5 illustrate the manner of folding of number 4 only generally.

Display member 2 may have extending through an upper portion thereof holes 9, as shown in FIG. 1, for the receipt of a cord or the like to allow the full suspension of the display unit.

Although a preferred embodiment of the present invention has been described and illustrated in detail, it will be apparent that various modifications may be made without departing from the scope of the present invention.

What is claimed is:

1. A display unit for displaying confectionary items having sticks, such as lollipops, said display unit comprising:

a planar display member formed of a rigid material and having front and rear sides;

a support member formed by a planar element folded along a pair of parallel fold lines to form a pair of parallel support legs extending substantially transverse to the plane of said element, said element having forward therein, adjacent each said fold line, cuts forming tabs such that when said legs are folded along said fold lines said tabs extend outwardly from said element in directions opposite to the directions of said legs;

an attachment and reinforcing member having a front side attached to said rear side of said display member and a rear side having forward therein slots positioned to receive said tabs of said support member, whereby said support member supports said attachment and reinforcing member, and said display member attached thereto, in an upright position;

said display member having extending therethrough a plurality of orifices arranged in columns, each said orifice being of a size to receive therein a stick of a confectionary item; and said front side of said attachment and reinforcing member having provided therein a plurality of elongated channels, each said channel being positioned to confront a respective said column of said orifices, whereby sticks extended through said orifices will abut against and be retained by walls of respective said channels.

2. A display unit as claimed in claim 1, wherein said display member has on said front side thereof decorative indicia.

3. A display unit as claimed in claims 1 or 2, wherein said display member is formed of a cardboard-type material.

4. A display unit as claimed in claim 1, wherein said legs of said support member are trapezoidal shaped.

5. A display unit as claimed in claims 1 or 4, wherein said element includes two pairs of longitudinally spaced said tabs.

6. A display unit as claimed in claims 1 or 4, wherein said tabs are hook-shaped and have upper recesses to receive said attachment and reinforcing member.

7. A display unit as claimed in claim 1, wherein said attachment and reinforcing member comprises a single member folded to form said front and back sides and said channels.

8. A display unit as claimed in claims 1 or 7, wherein said attachment and reinforcing member is formed of a cardboard-type material.

* * * * *